US012000601B2

(12) United States Patent
Takahashi et al.

(10) Patent No.: US 12,000,601 B2
(45) Date of Patent: Jun. 4, 2024

(54) AIR-CONDITIONING APPARATUS

(71) Applicant: Mitsubishi Electric Corporation, Tokyo (JP)

(72) Inventors: Satoshi Takahashi, Tokyo (JP); Masahiko Takagi, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 414 days.

(21) Appl. No.: 17/424,190

(22) PCT Filed: Mar. 29, 2019

(86) PCT No.: PCT/JP2019/014137

§ 371 (c)(1),
(2) Date: Jul. 20, 2021

(87) PCT Pub. No.: WO2020/202297

PCT Pub. Date: Oct. 8, 2020

(65) Prior Publication Data

US 2022/0074605 A1 Mar. 10, 2022

(51) Int. Cl.

| | |
|---|---|
| ***F24F 1/0011*** | (2019.01) |
| ***F24F 13/08*** | (2006.01) |
| ***F24F 13/20*** | (2006.01) |

(52) U.S. Cl.

CPC ..... *F24F 1/0011* (2013.01); *F24F 13/08* (2013.01); *F24F 13/20* (2013.01)

(58) Field of Classification Search

CPC ..... F24F 1/0011; F24F 13/08; F24F 13/20
USPC ..... 454/358
See application file for complete search history.

(56) References Cited

U.S. PATENT DOCUMENTS

| | | | | |
|---|---|---|---|---|
| 5,577,958 | A | 11/1996 | Kumekawa et al. | |
| 9,574,815 | B2 * | 2/2017 | Ikeda | F24F 1/0022 |

FOREIGN PATENT DOCUMENTS

| | | | |
|---|---|---|---|
| CN | 1125313 | A | 6/1996 |
| CN | 102227595 | A | 10/2011 |
| EP | 0 962 716 | A1 | 12/1999 |
| EP | 2 420 753 | A1 | 2/2012 |
| EP | 3 086 051 | A1 | 10/2016 |

(Continued)

OTHER PUBLICATIONS

Office Action dated Nov. 29, 2022 issued in corresponding CN Patent Application No. 201980094431.X (and English machine translation).

(Continued)

*Primary Examiner* — Allen R. B. Schult
(74) *Attorney, Agent, or Firm* — Posz Law Group, PLC

(57) ABSTRACT

An air-conditioning apparatus has an airflow direction deflector having a shaft located in a second airflow passage extending from a heat exchanger to an air outlet of an outer panel, the shaft being connected to a vane, and an airflow speed reducer provided between the heat exchanger and the shaft in the second airflow passage. The airflow speed reducer is spaced apart from a first airflow passage wall located between a first airflow passage extending from an air inlet of the outer panel to the heat exchanger and the second airflow passage. The airflow moves between the airflow speed reducer and the shaft at an airflow speed slower than the airflow speed thereof between the heat exchanger and the airflow speed reducer.

6 Claims, 4 Drawing Sheets

(56) References Cited

FOREIGN PATENT DOCUMENTS

| | | | |
|---|---|---|---|
| JP | H08-094160 | A | 4/1996 |
| JP | H09-264561 | A | 10/1997 |
| JP | H10-205795 | A | 8/1998 |
| JP | H11-118234 | A | 4/1999 |
| WO | 2015/092926 | A1 | 6/2015 |

OTHER PUBLICATIONS

International Search Report dated May 14, 2019, issued in corresponding International Application No. PCT/JP2019/014137 (and English Machine Translation).
Office Action dated May 25, 2022 issued in corresponding CN Patent Application No. 201980094431.X (and English translation).
Office Action dated Jun. 14, 2022 issued in corresponding JP Patent Application No. 2021-510629 (and English translation).
Examination Report dated Jul. 14, 2022 issued in corresponding AU Patent Application No. 2019438545.

* cited by examiner

AIR-CONDITIONING APPARATUS

CROSS REFERENCE TO RELATED APPLICATION

This application is a U.S. National Stage Application of International Application No. PCT/JP2019/014137, filed on Mar. 29, 2019, the contents of which are incorporated herein by reference.

TECHNICAL FIELD

The present disclosure relates to an air-conditioning apparatus having an airflow direction deflector.

BACKGROUND ART

Patent Literature 1 discloses an air-conditioning apparatus having an airflow direction deflector at an air outlet. In Patent Literature 1, a guide plate is provided on the upstream side of air of both axial ends of the vane of the airflow direction deflector. The guide plate has a plurality of openings, and a part of the airflow whose heat is exchanged on the upstream side of air of the guide plate is guided to the end of the vane through the openings of the guide plate. The guide plate also covers both ends of the vane in the axial direction when viewed from the upstream side of air of the guide plate.

CITATION LIST

Patent Literature

Patent Literature 1: Japanese Unexamined Patent Application Publication No. H10-205795

SUMMARY OF INVENTION

Technical Problem

In Patent Literature 1, the amount and velocity of the airflow guided into the vane by the guide plate decrease as it approaches the shaft provided at both ends of the vane. Therefore, the airflow guided to the shaft stays around the shaft without being diffused from the air outlet, and is suctioned from the air inlet without being diffused from the air outlet. In particular, if the stagnant air is cold air, the area around the air inlet of the air-conditioning apparatus is cooled by the cold air. Therefore, in the air-conditioning apparatus of Patent Literature 1, there is a problem that condensation may occur around the air inlet due to the stagnant air in the space around the shaft being suctioned from the air inlet.

The technique of present disclosure aims to overcome the above-mentioned problem, and to prevent the generation of condensation in the air-conditioning apparatus by suppressing the stagnation of the airflow at the space around the shaft.

Solution to Problem

The air-conditioning apparatus of the present disclosure comprises an outer panel having an air inlet and an air outlet; a fan that forces air to move from the air inlet to the air outlet; a heat exchanger that exchanges heat with air moved from the air inlet to the air outlet; a first airflow passage wall located between a first airflow passage extending from the air inlet to the heat exchanger, and a second airflow passage extending from the heat exchanger to the air outlet, the first airflow passage wall extending from between the air inlet and the air outlet of the outer panel to the heat exchanger; a second airflow passage wall being opposite to the first airflow passage wall; a third airflow passage wall connected to the first airflow passage wall and the second airflow passage wall, and forms the second airflow passage together with the first airflow passage wall and the second airflow passage wall; an airflow direction deflector located in the second airflow passage and having a vane and a shaft connected to the vane, the shaft being rotatably supported by the third airflow passage wall, an airflow speed reducer provided between the heat exchanger and the shaft in the second airflow passage, wherein the airflow speed reducer is connected to the second airflow passage wall and the third airflow passage wall, protrudes from the second airflow passage wall and the third airflow passage wall, is spaced apart from the first airflow passage wall, and is configured to reduce airflow speed such that the airflow moves between the airflow speed reducer and the shaft in the second airflow passage at an airflow speed slower than the airflow speed thereof between the heat exchanger and the airflow speed reducer.

Advantageous Effects of Invention

In the air-conditioning apparatus of the present disclosure, a part of the airflow through the second airflow passage passes through the gap between the first airflow passage wall and the airflow speed reducer and through the space between the shaft and the first airflow passage wall. The air passing through the space between the shaft and the first airflow passage wall induces the air around the shaft and diffuses it from the air outlet. Therefore, the air-conditioning apparatus of the present disclosure can prevent condensation from occurring because it can suppress the air that stagnates around the shaft from being suctioned from the air inlet.

DESCRIPTION OF EMBODIMENTS

Embodiment 1

Figure 1:
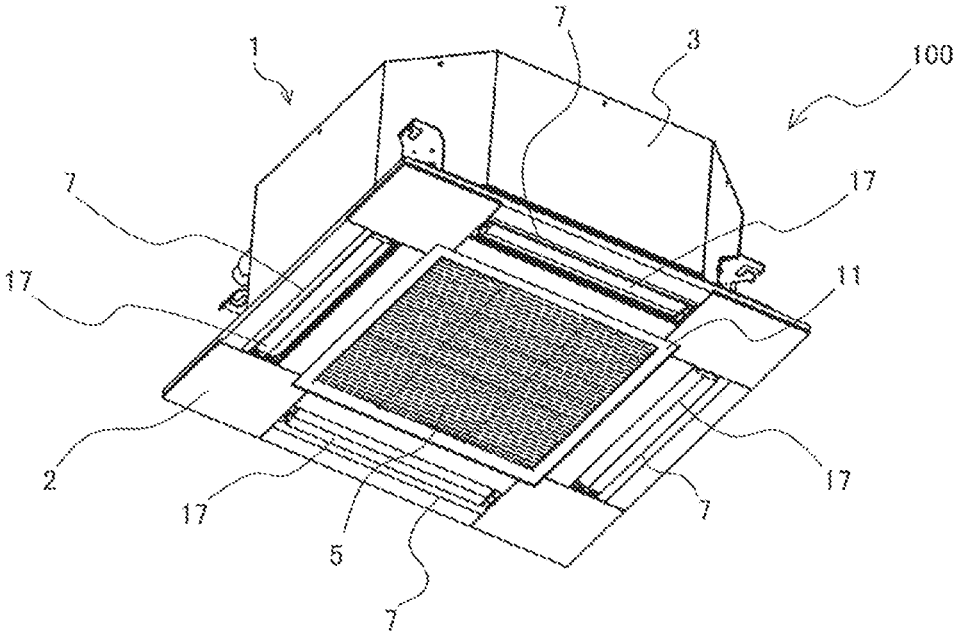
FIG. 1 is a perspective view schematically showing an exemplary configuration of exterior of an indoor unit of an air-conditioning apparatus according to Embodiment 1.
Figure 2:
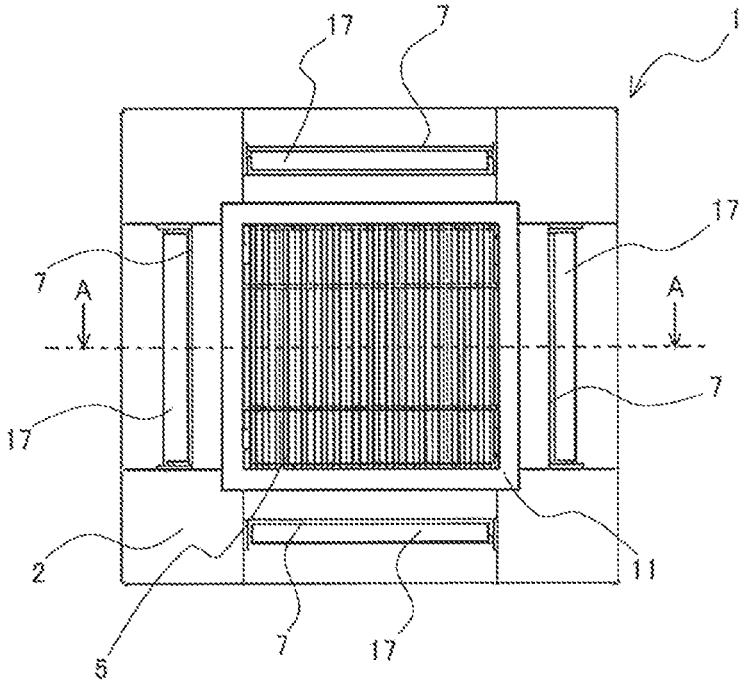
FIG. 2 is a schematic plan view of the indoor unit in FIG. 1, as viewed in a direction to a front surface of an outer panel.
Figure 3:
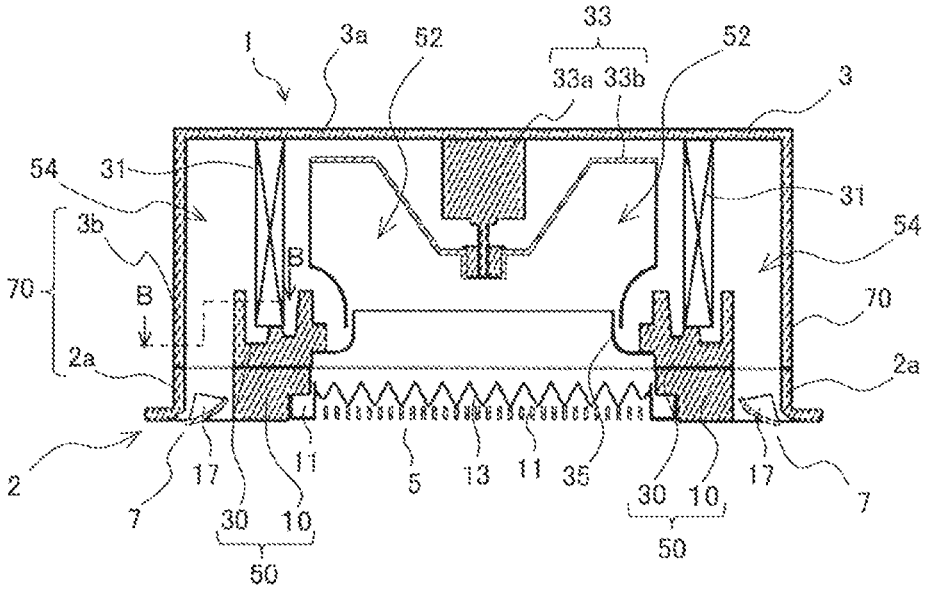
FIG. 3 is a cross-sectional view schematically showing a cross-section taken along line A-A in FIG. 2.

The following describes an air-conditioning apparatus 100 of Embodiment 1. FIG. 1 is a perspective view schematically showing an exemplary configuration of the exterior of the indoor unit 1 of the air-conditioning apparatus 100 of Embodiment 1. FIG. 2 is a schematic plan view of the indoor unit 1 of FIG. 1 as viewed in the direction to the front surface of the outer panel 2. FIG. 3 is a cross-sectional view schematically showing the cross section taken along the line A-A of FIG. 2. In the following drawings, including FIGS. 1 to 3, the relationship of dimensions and the shapes of components may differ from the actual ones. In the following drawings, including FIGS. 1 to 3, same signs are attached to the same or equivalent components, or, those parts or components having same or equivalent functions, or, the signs may be omitted in those cases. In addition, the positional relationship between each component of the indoor unit 1, such as up and down, left and right, front and back, etc., is, in principle, the positional relationship when the indoor unit 1 is installed in a usable state.

As shown in FIGS. 1 and 2, the indoor unit 1 of the air-conditioning apparatus 100 is formed as a ceiling-embedded cassette-type indoor unit 1, and has an outer panel 2 and a casing 3. The outer panel 2 is placed on the ceiling of the room to be air-conditioned, and the surface of the outer panel 2 is a design surface of the indoor unit 1. The casing 3 is placed in a space above a ceiling. The outer shell 2*a* of the outer panel 2 is fixed to the casing 3 by screwing or press fitting.

The outer panel 2 has an air inlet 5 in a central part of the outer panel 2 that communicates with the inside of the casing 3. In addition, the outer panel 2 has an air outlet 7, which is located around the air inlet 5 and is connected to the inside of the casing 3. In the outer panel 2 of FIGS. 1 and 2, four separate air outlets 7 are arranged around the air inlet 5, but one air outlet 7 may be arranged around the entire circumference of the air inlet 5. Also, in outer panel 2, two air outlets 7 may be arranged across the air inlet 5, or one air outlet 7 may be arranged in a part of the circumference of the air inlet 5.

As shown in FIG. 3, the back of the outer panel 2 has a partition wall 10 formed along the periphery of the air inlet 5. The outer panel 2 is divided by the partition wall 10 into an airflow passage communicating with the air inlet 5 and an airflow passage communicating with the air outlet 7.

The outer panel 2 has a grille 11 covering the air inlet 5 and a filter 13 disposed on the back side of the grille 11.

The grille 11 has a plurality of vents in a grid shape. The grille 11 is a lid that is removably attached to the partition wall 10, and also functions as a service panel for maintenance of the interior of the indoor unit 1, such as replacement or cleaning of the filter 13.

The filter 13 is a porous member that captures dust or bacteria out of the air suctioned from the air inlet 5. The filter 13 is removably attached to the grille 11 to make ease of replacement or cleaning.

An airflow direction deflector 17 is arranged between the outer shell 2*a* of the outer panel 2 and the partition wall 10 to adjust the direction of air blown from the air outlet 7. The configuration of the deflector 17 will be described later.

The configuration of airflow direction deflector 17 will be described later.

Inside the casing 3, a drain pan 30, a heat exchanger 31, a fan 33, and a bell mouth 35 are provided.

The drain pan 30 is a receptacle to receive drain water generated by condensation of the heat exchanger 31. As shown in FIG. 3, the drain pan 30 is placed between the partition wall 10 and the heat exchanger 31. The drain pan 30 is placed on the top part of the partition wall 10, and the drain pan 30 is placed below the heat exchanger 31. In FIG. 3, the drain pan 30 is shown as a separate component from the partition wall 10, but it may be integrally formed with the partition wall 10.

The heat exchanger 31 is a heat transfer device that transfers and exchanges heat energy between two fluids having different heat energy. As the heat exchanger 31, an air-cooled heat exchanger that performs heat exchange between air passing through heat exchanger 31 and refrigerant circulating inside heat exchanger 31 is used. For example, as the heat exchanger 31, a fin-and-tube type heat exchanger is used that includes a plurality of plate-shaped fins arranged in parallel and a heat transfer tube penetrating the plurality of plate-shaped fins, and heat is exchanged between air passing through the plurality of plate-shaped fins and refrigerant flowing through the heat transfer tube. In the case where heat exchanger 31 is a fin-and-tube type heat exchanger, the heat exchanger 31 is placed such that the heat transfer tubes are aligned in a direction away from drain pan 30 and one end of each of the heat transfer tubes is placed on the drain pan. The heat exchanger 31 is fixed to the casing 3, for example, by suspending it from the upper wall 3*a* of the casing 3. The lower part of the heat exchanger 31 is placed on the drain pan 30.

The inside of the indoor unit 1 is divided into the air path from the air inlet 5 to the heat exchanger 31 and the air path from the heat exchanger 31 to the air outlet 7 by the drain pan 30 and the partition wall 10. In other words, the drain pan 30 and partition wall 10 are provided between the first airflow passage 52 extending from the air inlet 5 to the heat exchanger 31 and the second airflow passage 54 extending from the heat exchanger 31 to the air outlet 7, and serves as the airflow passage wall extending from between the air inlet 5 and the air outlet 7 of the outer panel 2 to the heat exchanger 31. In the following description, when the drain pan 30 and the partition wall 10 are treated as a configuration to serves as an airflow passage wall, and when there is no need to distinguish between them, the airflow passage wall having the drain pan 30 and the partition wall 10 is referred to as the first airflow passage wall 50.

The partition wall 10 faces the outer shell 2*a* of the outer panel 2 through the second airflow passage 54, and the drain pan 30 faces a part of the side wall 3*b* of the casing 3 through the second airflow passage 54. The drain pan 30 faces a part of the side wall 3*b* of casing 3 via second airflow passage 54. In other words, the outer shell 2*a* of the outer panel 2 and part of the side wall 3*b* of the casing 3 serves as the air passage wall of the second airflow passage 54 opposite to the first airflow passage wall 50. In the following description, when a part of the side wall 3*b* and the outer shell 2*a* of the casing 3 are treated as a configuration that functions as an airflow passage wall, and when there is no particular need to distinguish between them, the airflow passage wall with a part of side wall 3*b* and the outer shell 2*a* of the casing 3 is referred to as the second airflow passage wall 70.

The fan 33 is a rotating machine that forces air to move from the air inlet 5 to the air outlet 7. The fan 33 is arranged so that the suction side faces the grille 11 and the axis of rotation of the motor 33*a* of fan 33 faces the side where the air inlet 5 is located. The fan 33 is arranged so that the axis of rotation of motor 33*a* of the fan 33 faces the side where the air inlet 5 is located. The fan includes, around the rotation axis of the motor, a plurality of blades 33*b* configured to force air suctioned from the air inlet. For example, a centrifugal fan such as a multi-blade type sirocco fan is used as the fan 33.

The bell mouth 35 is an airflow guide part configured to guide air from the air inlet 5 to the suction side of the fan 33. The bell mouth 35 is fixed to the drain pan 30 by, for example, screwing. If the shape of the drain pan 30 on the side of the first airflow passage 52 is a shape that can guide the air from the air inlet 5 to the suction side of the fan 33, the bell mouth 35 can be omitted.

When the indoor unit 1 is in operation and the fan 33 rotates, the air in the room is moved from the air inlet 5 to the heat exchanger 31 through the first airflow passage 52 by the guided flow generated by the rotation of the fan 33. At the heat exchanger 31, air passing through the heat exchanger 31 is subjected to heat exchange with refrigerant flowing inside the heat exchanger 31. The air whose heat is exchanged at the heat exchanger 31 is moved to air outlet 7 through second airflow passage 54 by guided flow generated by rotation of fan 33. The air whose heat is exchanged in the heat exchanger 31 is blown into the room from the air outlet 7 through the second airflow passage 54 by the guided flow generated by the rotation of the fan 33.

Figure 4:
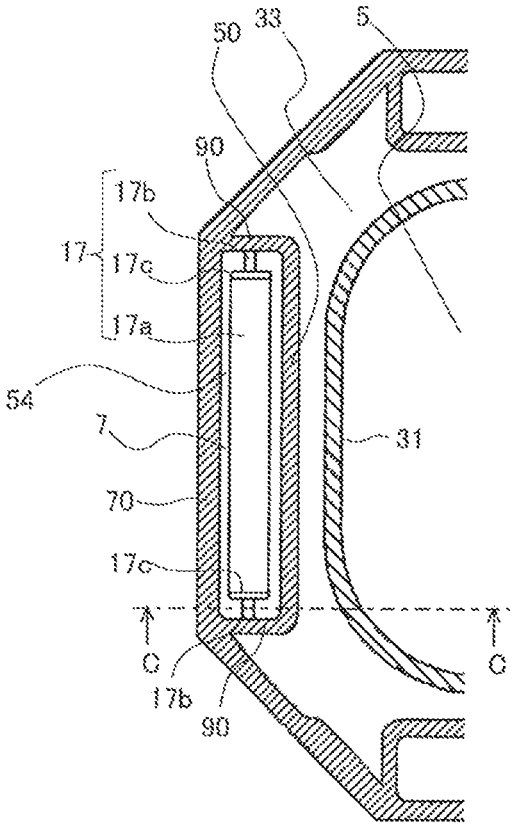
FIG. 4 is a schematic cross-sectional view showing a cross-section taken along line B-B in FIG. 3.
Figure 5:
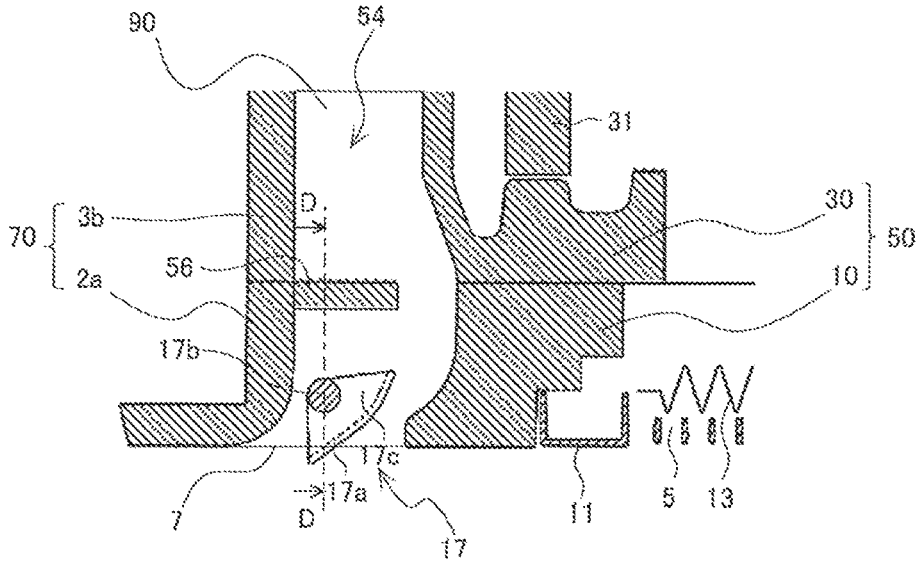
FIG. 5 is a schematic cross-sectional view showing a cross-section taken along line C-C in FIG. 4.
Figure 6:
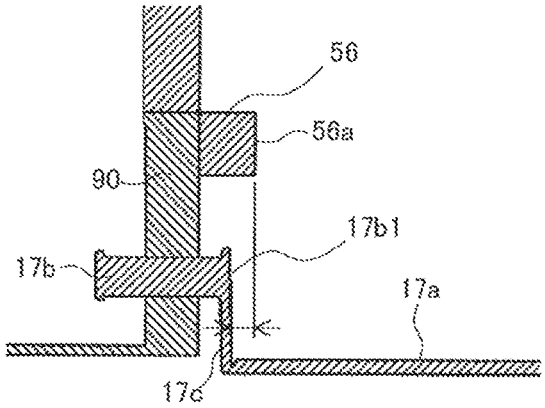
FIG. 6 is a schematic cross-sectional view showing a cross-section taken along line D-D in FIG. 5.

Next, the configuration of the airflow direction deflector 17 will be explained using FIGS. 4 to 6. FIG. 4 is a schematic cross-sectional view showing the cross-section taken along the line B-B of FIG. 3. FIG. 5 is a schematic cross-sectional view showing the cross-section taken along the line C-C of FIG. 4. FIG. 6 is a schematic cross-sectional view showing the cross-section taken along the line D-D of FIG. 5.

As shown in FIG. 4, the airflow direction deflector 17 is located between the first airflow passage wall 50 and the second airflow passage wall 70, i.e., in the second airflow passage 54. By being provided with the airflow direction deflector 17, the indoor unit can adjust the direction of the air blown out from the air outlet 7 can be adjusted.

The airflow direction deflector 17 has a vane 17*a* and a shaft 17*b* provided on the vane 17*a*. For example, a plate member with a curved surface shape is used as the vane 17*a*. The airflow direction deflector 17 in FIG. 4 has a plate-shaped arm 17*c* that connects between the vane 17*a* and the shaft 17*b*. The airflow direction deflector 17 may be one entirety that directly connects the vane 17*a* and the shaft 17*b* and in which the arm 17*c* is omitted.

As shown in FIG. 4, the shaft 17*b* is provided along the second airflow passage 54 and is rotatably supported by the third airflow passage wall 90 connected to first airflow passage wall 50 and second airflow passage wall 70. In other words, the third airflow passage wall 90 functions as a bearing for the shaft 17*b*, and is provided in a paired position via the second airflow passage 54. In FIG. 4, the third airflow passage wall 90 is directly connected to the first airflow passage wall 50 and the second airflow passage wall 70, but it may also be connected via another airflow passage wall provided between the airflow passage wall 90 and the first airflow passage wall 50 or second airflow passage wall 70.

In FIG. 4, a portion of the heat exchanger 31 curved in an O-shape is illustrated, but four flat heat exchangers 31 arranged in an O-shape may also be used.

As shown in FIGS. 5 and 6, an airflow speed reducer 56 is provided between the heat exchanger 31 and the shaft 17*b* in the second airflow passage 54. The airflow speed reducer 56 is connected to the second airflow passage wall 70 and third airflow passage wall 90, and protrudes from the second airflow passage wall 70 and third airflow passage wall 90. The airflow speed reducer 56 can be integrally formed with the second airflow passage wall 70 and third airflow passage wall 90. By forming the airflow speed reducer 56 integrally with the second airflow passage wall 70 and the third airflow passage wall 90, the process of installing the airflow speed reducer 56 becomes unnecessary during the manufacture of the indoor unit 1, thereby reducing the man-hours required for the manufacture of the indoor unit 1.

As shown in FIG. 5, the airflow speed reducer 56 is spaced apart from the first airflow passage wall 50. The dimension of the airflow speed reducer 56 in the direction from the second airflow passage wall 70 to the first airflow passage wall 50 is larger than the dimension thereof from the second airflow passage wall 70 to the shaft 17*b*. As shown in FIG. 6, in the direction away from the third airflow passage wall 90, the position of the front end 56*a* of the airflow speed reducer 56 is more away from the third airflow passage wall 90 than the position of the front end 17*b*1 on the vane 17*a* side of the shaft 17*b*. The position of the front end 56*a* of airflow speed reducer 56 is more away from the third airflow passage wall 90 than the position of the front end 17*b*1 on the vane 17*a* side of the shaft 17*b* is.

Figure 7:
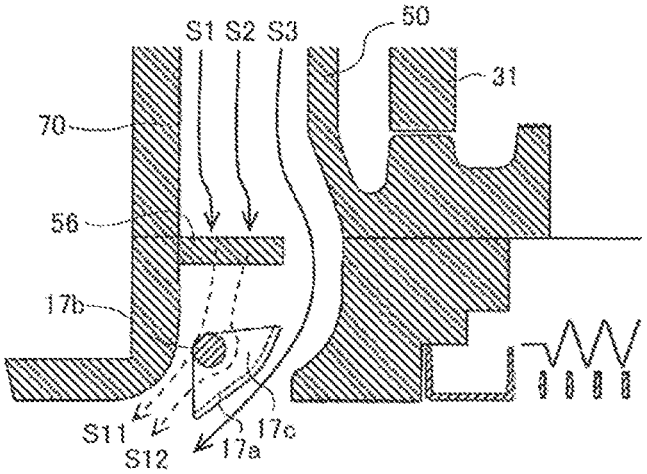
FIG. 7 is a schematic view showing flows of air around a shaft in the cross-sectional view of FIG. 5.

FIG. 7 is a schematic of the cross-sectional view of FIG. 5 showing the airflow in the vicinity of the shaft 17*b*. The solid arrows S1 and S2 schematically show the airflow between the heat exchanger 31 and the airflow speed reducer 56. The dotted arrows S11 and S12 schematically show the airflow between the airflow speed reducer 56 and the shaft 17*b*. The solid arrow S3 schematically shows the airflow passing between the airflow speed reducer 56 and the first airflow passage wall 50.

In Embodiment 1, an airflow speed reducer 56 is provided between the heat exchanger 31 and the shaft 17*b* in the second airflow passage 54. The airflow speed reducer 56 is connected to the second airflow passage wall 70 and the third airflow passage wall 90. The dimension of the airflow speed reducer 56 in the direction from the second airflow passage wall 70 to the first airflow passage wall 50 is larger than the dimension thereof from the second airflow passage wall 70 to the shaft 17*b*. Also, in the direction away from the third airflow passage wall 90, the position of the front end 56*a* of the airflow speed reducer 56 is more away than the position of the front end 17*b*1 on the vane 17*a* side of the shaft 17*b*. In other words, in Embodiment 1, the shaft 17*b* is covered by the airflow speed reducer 56 when viewed from the upstream side of the air flow.

The airflow speed of the airflow towards the shaft 17*b*, shown by the solid arrows S1 and S2, is reduced by the airflow speed reducer 56. Therefore, when the indoor unit 1 performs cooling operation to supply cool air to the room, the direct arrival of cool air to the shaft 17*b* can be suppressed.

When cold air reaches the shaft 17*b* directly, the airflow speed around the shaft 17*b* increases, and the airflow around the shaft 17*b* becomes stripped, resulting in a negative pressure. When the pressure around the shaft 17*b* becomes negative and hot and humid room air is sucked into the vicinity of the shaft 17*b*, condensation may occur in downstream of the shaft 17*b*.

Therefore, by shielding the entire shaft 17*b* from the air flow, the negative pressure in the vicinity of the shaft 17*b* can be prevented, thus preventing condensation from forming in downstream of the shaft 17*b*.

A part of the airflow passing between the airflow speed reducer 56 and the first airflow passage wall 50 flows between the airflow speed reducer 56 and the shaft 17*b*, as shown by the dotted arrows S11 and S12. On the other hand, due to the installation of the airflow speed reducer 56, the airflow speed between the airflow speed reducer 56 and the shaft 17*b* becomes smaller than that between the heat exchanger 31 and the airflow speed reducer 56.

In Embodiment 1, the airflow speed reducer 56 is spaced apart from the first airflow passage wall 50. Therefore, as shown by the solid arrow S3, a part of the airflow between the heat exchanger 31 and the airflow speed reducer 56 can flow through the gap between the airflow speed reducer 56 and the first airflow passage wall 50 without reducing the airflow speed.

The slow airflow between the airflow speed reducer 56 and the shaft 17*b*, indicated by the dotted arrows S11 and S12, is guided by the airflow passing between the airflow speed reducer 56 and the first airflow passage wall 50, indicated by the solid arrow S3. The slow airflow between the airflow speed reducer 56 and the first airflow passage wall 50, indicated by the solid arrow S3, is attracted by the airflow passing between the airflow speed reducer 56 and the first airflow passage wall 50 and diffused from the air outlet 7. In other words, the airflow flowing at a low speed around the shaft 17*b* shown by the dotted arrows S11 and S12 is diffused from air outlet 7 without stagnating around the shaft 17*b*. Therefore, it is possible to suppress the occurrence of the so-called short cycle in which the airflow stagnating around the shaft 17*b* is not diffused from the air outlet 7 and is re-suctioned from the air inlet 5 by the guided flow of the fan 33. In particular, by suppressing the occurrence of the short cycle, when the airflow is cold air, the area around the air inlet 5 of the indoor unit 1 is cooled by the cold air, and condensation can be prevented from occurring around the air inlet 5.

Based on the above, Embodiment 1 can prevent condensation from occurring in outer panel 2 because it can suppress the generation of condensation in downstream of the shaft 17*b* and the stagnation of airflow in the space around the shaft 17B.

Embodiment 2

Figure 8:
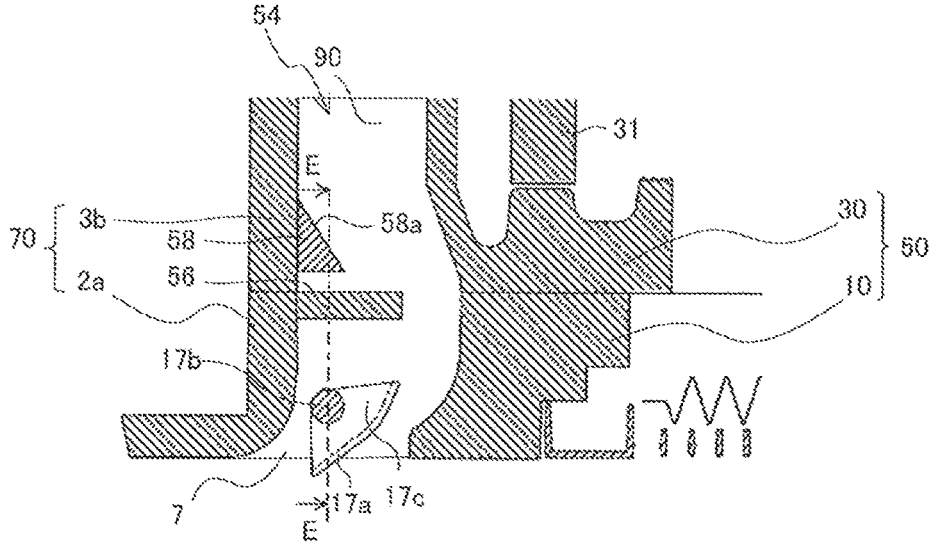
FIG. 8 is a cross-sectional view schematically showing the cross-section taken along line C-C in FIG. 4 in Embodiment 2.
Figure 9:
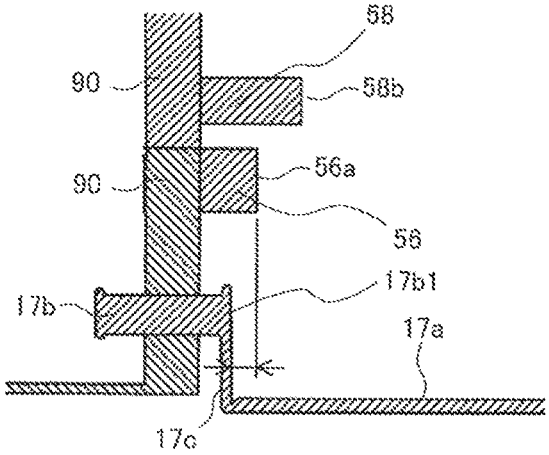
FIG. 9 is a cross-sectional view schematically showing a cross-section taken along line E-E in FIG. 8.

Embodiment 2 will be described using FIGS. 8 and 9. FIG. 8 is a cross-sectional view taken along the line C-C of FIG. 4 in Embodiment 2. FIG. 9 shows the cross-section taken along the line E-E of FIG. 8. The configuration of indoor unit 1 shown in FIGS. 1 to 3 is the same in Embodiment 2, so the explanation is omitted. In the following description, only the configuration that differs from Embodiment 1 described above will be explained.

As shown in FIGS. 8 and 9, in Embodiment 2, an airflow guide part 58 is provided in upstream of the airflow speed reducer 56. The airflow guide part 58 is connected to second airflow passage wall 70. The airflow guide part 58 can be formed integrally with the second airflow passage wall 70. By forming the airflow guide part 58 integrally with the second airflow passage wall 70, the process of installing the airflow guide part 58 becomes unnecessary during the manufacture of the indoor unit 1, thus reducing the man-hours required for the manufacture of the indoor unit 1.

As shown in FIG. 8, the airflow guide part 58 is spaced apart from the first airflow passage wall 50. Also as shown in FIG. 8, the airflow guide part 58 has an airflow guide surface 58*a* that is inclined in the downstream direction of the second airflow passage 54, the airflow guide surface 58*a* extending from the second airflow passage wall 70 to the first airflow passage wall 50. As shown in FIG. 9, in the direction away from the third airflow passage wall 90, the position of the front end 58*b* of the airflow guide part 58 is more away from the third airflow passage wall 90 than the position of the front end 56*a* of the airflow speed reducer 56 is.

Figure 10:
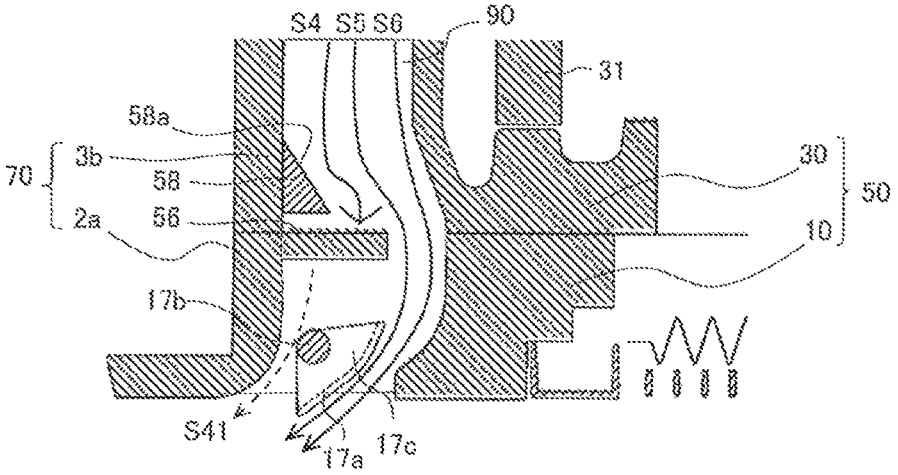
FIG. 10 is a schematic view showing flows of air around a shaft in the cross-sectional view of FIG. 9.

FIG. 10 is a schematic view of the cross section of FIG. 8 showing the airflow in the vicinity of the shaft 17*b*. The solid arrow S4 schematically shows the airflow before reaching the airflow speed reducer 56 and the dotted arrow S41 schematically shows the airflow after reaching the airflow speed reducer 56. The solid arrows S5 and S6 schematically show the airflow passing between the airflow speed reducer 56 and the first airflow passage wall 50.

In Embodiment 2, the airflow guide part 58 is provided in upstream of the airflow speed reducer 56, and the airflow guide part 58 is connected to the second airflow passage wall 70. The position of the front end 58*b* of the airflow guide part 58 is more away from the third airflow passage wall 90 than the position of the front end 56*a* of the airflow speed reducer 56 is. In other words, in Embodiment 2, the entire shaft 17*b* is further shielded from the airflow by the airflow guide part 58, and the airflow toward the shaft 17*b* is further reduced by the airflow guide part 58, as shown by the solid arrows S4 and S5. The airflow towards the shaft 17*b* is further reduced by airflow guide part 58, as shown by solid arrows S4 and S5. Therefore, for example, when indoor unit 1 performs cooling operation to supply cool air to the room, the direct arrival of cool air to the shaft 17*b* can be further suppressed.

In addition, in Embodiment 2, the airflow guide part 58 is spaced apart from first airflow passage wall 50 and airflow speed reducer 56, so that air can be guided toward the gap between first airflow passage wall 50 and airflow speed reducer 56. In particular, when the airflow guide surface 58*a* is provided on the airflow guide part 58, the airflow between the first airflow passage wall 50 and the airflow speed reducer 56 can be increased, as shown by the solid arrows S5 and S6. Thus, the slower airflow flowing near the shaft 17*b*, shown by the dotted arrow S41, is more reliably diffused from the air outlet 7 instead of stagnating around the shaft 17*b*.

From the above, the airflow guide part 58 of Embodiment 2 can further prevent the generation of condensation in the outer panel 2 because it can further suppress the generation of condensation in downstream of the shaft 17*b* and the stagnation of airflow in the space around the shaft 17*b*. This can further prevent condensation on the outer panel 2.

OTHER EMBODIMENTS

The present disclosure is not limited to the above-described Embodiment, and various modifications are possible within the scope not deviating from the gist of the present disclosure. For example, in the above-described Embodiment, a separate type air-conditioning apparatus 100 having an indoor unit 1 was described as an example. However, if the air inlet 5 and the air outlet 7 are located adjacent to each other, the above-described configuration of Embodiment can be applied to other types of air-conditioning apparatus 100 as well. For example, the above-described Embodiment configuration is equally applicable to an integrated ceiling-embedded cassette type air-conditioning apparatus 100. Also, the configuration of the Embodiment described above is equally applicable to a floor-standing or wall-hanging air-conditioning apparatus 100, regardless of whether it is an integrated type or a separate type.

The first airflow passage wall 50 can have other configurations as long as it is an airflow passage wall extending from between the air inlet 5 and it is not limited to the air outlet 7 of the outer panel 2 to the heat exchanger 31, and the airflow passage wall with drain pan 30 and partition wall 10. The second airflow passage wall 70 may be a separate airflow passage wall separate from the outer shell 2*a* of the outer panel 2 or a part of the casing 3, as long as it is an airflow passage wall facing the first airflow passage wall 50 across the second airflow passage 54.

REFERENCE SIGNS LIST

1 indoor unit, 2 outer panel, 2*a* outer shell, 3 casing, 3*a* upper wall, 3*b* side wall, 5 air inlet, 7 air outlet, 10 partition wall, 11 grille, 13 filter, 17 airflow direction deflector, 17*a* vane, 17*b* shaft, 17*b*1 front end, 17*c* arm, 30 drain pan, 31 heat exchanger, 33 fan, 33*a* motor, 33*b* blade, 35 bell mouth, 50 first airflow passage wall, 52 first airflow passage, 54 second airflow passage, 56 airflow speed reducer, 56*a* front end, 58 airflow guide part, 58*a* airflow guide surface, 58*b* front end, 70 second airflow passage wall, 90 third airflow passage wall, 100 air-conditioning apparatus.

The invention claimed is:

1. An air-conditioning apparatus comprising:

an outer panel having an air inlet and an air outlet;

a fan that forces air to move from the air inlet to the air outlet;

a heat exchanger that exchanges heat with air moved from the air inlet to the air outlet;

a first airflow passage wall located between a first airflow passage extending from the air inlet to the heat exchanger, and a second airflow passage extending from the heat exchanger to the air outlet, the first airflow passage wall extending from between the air inlet and the air outlet of the outer panel to the heat exchanger;

a second airflow passage wall being opposite to the first airflow passage wall;

a third airflow passage wall connected to the first airflow passage wall and the second airflow passage wall, and forms the second airflow passage together with the first airflow passage wall and the second airflow passage wall;

an airflow direction deflector located in the second airflow passage and having a vane and a shaft connected to the vane, the shaft being rotatably supported by the third airflow passage wall, an airflow speed reducer provided between the heat exchanger and the shaft in the second airflow passage, the airflow speed reducer is disposed to be in an upstream direction from the vane, wherein the airflow speed reducer is directly connected to both the second airflow passage wall and the third airflow passage wall, protrudes from the second airflow passage wall and the third airflow passage wall, is spaced apart from the first airflow passage wall, and is configured to reduce airflow speed such that the airflow moves between the airflow speed reducer and the shaft in the second airflow passage at an airflow speed slower than an airflow speed thereof between the heat exchanger and the airflow speed reducer, wherein a dimension of the airflow speed reducer in a direction from the second airflow passage wall to the first airflow passage wall is larger than a dimension thereof from the second airflow passage wall to the shaft, and in a direction away from the third airflow passage wall, a position of a front end of the airflow speed reducer is more away from the third airflow passage wall than a position of a front end of the shaft on a vane side is.

2. The air-conditioning apparatus of claim 1, further comprising an airflow guide part provided between the heat exchanger and the airflow speed reducer in the second airflow passage and being configured to direct air towards a gap between the first airflow passage wall and the airflow speed reducer, wherein the airflow guide part is connected to the second airflow passage wall and is spaced apart from the first airflow passage wall.

3. The air conditioning apparatus of claim 2, wherein the airflow guide part has an airflow guide surface inclined in a downstream direction of the second airflow passage, the airflow guide surface extending from the second airflow passage wall to the first airflow passage wall.

4. The air-conditioning apparatus of claim 2, wherein a position of a front end of the airflow guide part is more away from the third airflow passage wall than the position of the front end of the airflow speed reducer is.

5. The air-conditioning apparatus of claim 2, wherein the airflow guide part is integrally formed with the second airflow passage wall.

6. The air-conditioning apparatus of claim 1, wherein the airflow speed reducer is integrally formed with the second airflow passage wall and the third airflow passage wall.

* * * * *